United States Patent [19]

Ambrose et al.

[11] 3,940,932

[45] Mar. 2, 1976

[54] NONCOMBUSTION ENGINE

[75] Inventors: Robert Ambrose, Lynnfield; Lewis H. Noll, Topsfield, both of Mass.

[73] Assignee: Lance Engineering Co., Inc., Salem, Mass.

[22] Filed: Nov. 13, 1973

[21] Appl. No.: 414,701

[52] U.S. Cl. ..... 60/517; 74/89; 74/569

[51] Int. Cl.[2] ..... F02G 1/04

[58] Field of Search ..... 60/516–525

[56] References Cited

UNITED STATES PATENTS 3,708,979 1/1973 Bush et al. ..... 60/516 X

OTHER PUBLICATIONS

Engineering Thermodynamics, by Jones and Hawkins, John Wiley & Sons: New York 1963. p. 243.

*Primary Examiner*—Allen M. Ostrager

*Attorney, Agent, or Firm*—Thomas C. Stover, Jr.

[57] ABSTRACT

In a closed Stirling Cycle system gas, such as dried air, is heated and expanded within a power piston chamber, driving the power piston outwardly of the chamber into contact with a cam groove of a flywheel, rotating the flywheel. When the power piston reaches the top of its stroke, the cam slope reverses, and drives the power piston back into its chamber expelling the heated gas therefrom into one or more cooling chambers, cooling and contracting the gas which is then charged into a recovery piston chamber, driving the recovery piston outwardly of its chamber into contact with another cam groove of the flywheel. When the recovery piston reaches the top of its stroke, its cam groove reverses and drives the recovery piston back into its chamber, expelling the cooled gas therefrom back to the power piston chamber recommencing the power cycle to drive the flywheel. Preferably, several pair of power-recovery pistons operate out of phase to drive the flywheel.

21 Claims, 16 Drawing Figures

FIG.2
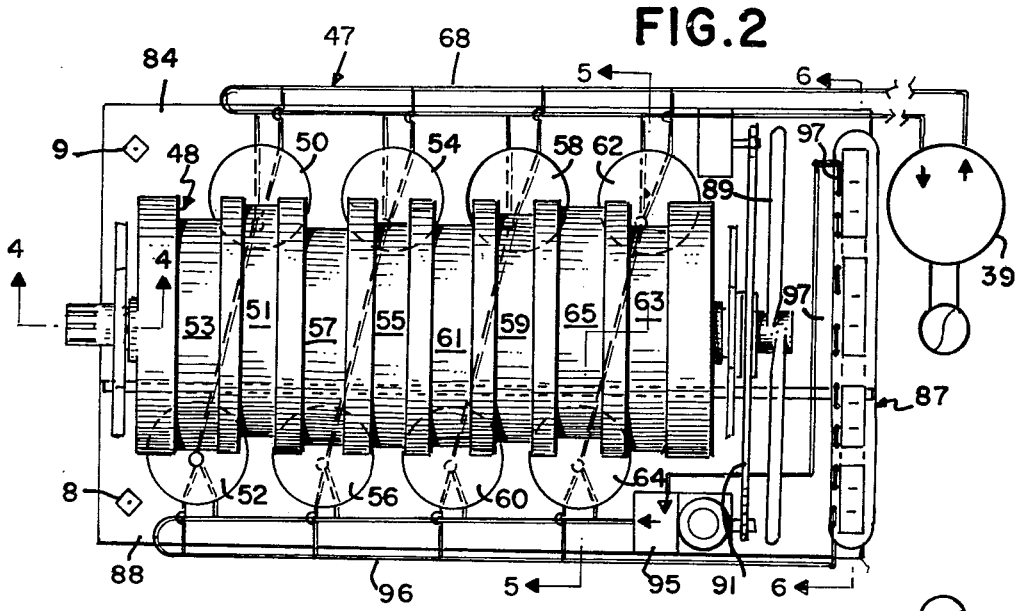
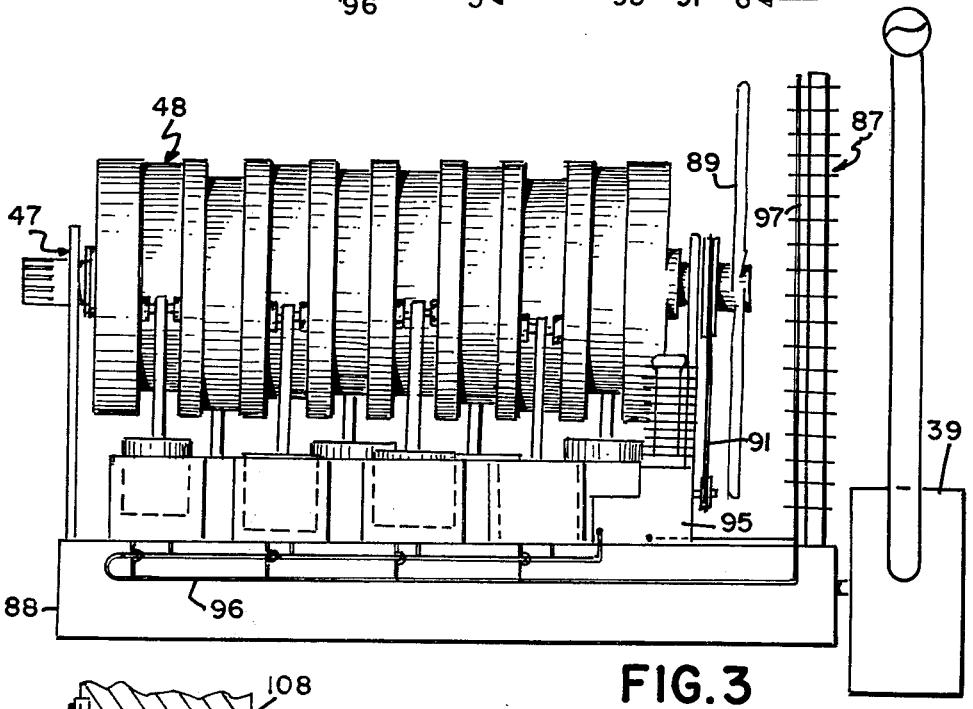
FIG.3
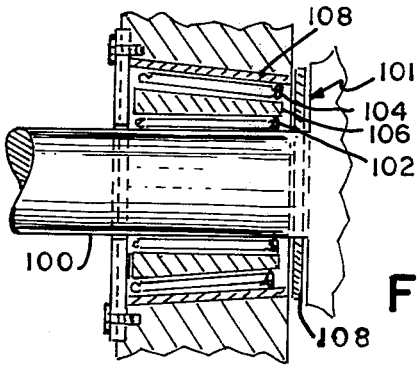
FIG.4

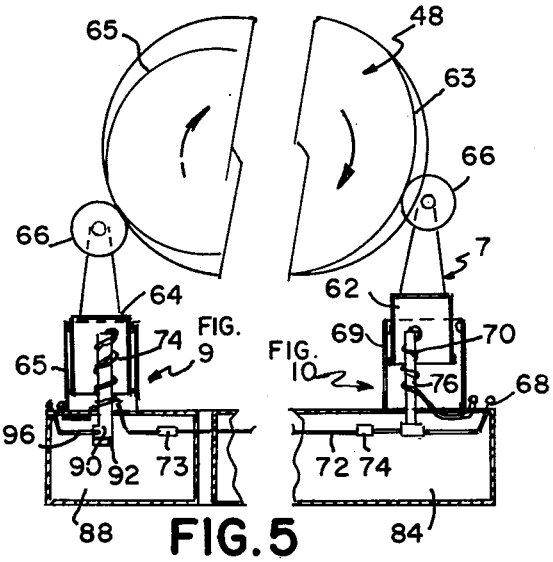
FIG.5
FIG.6
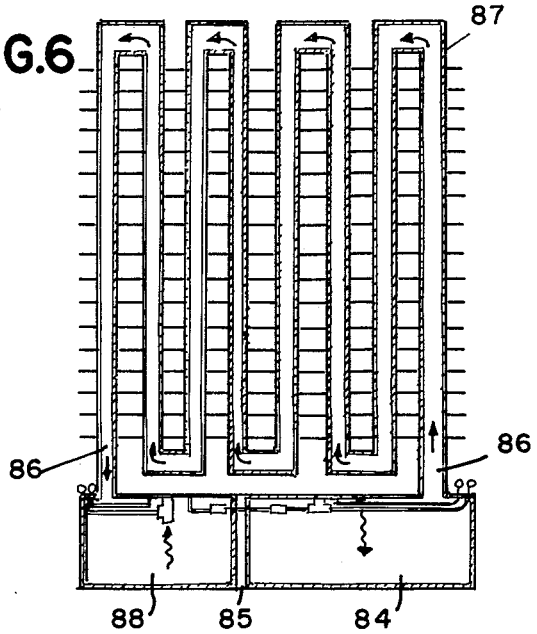
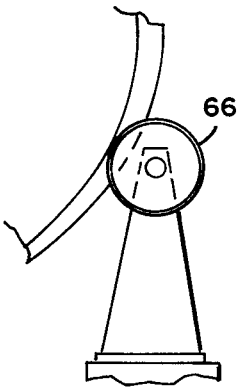
FIG.7
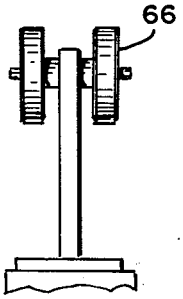
FIG.8
FIG.9
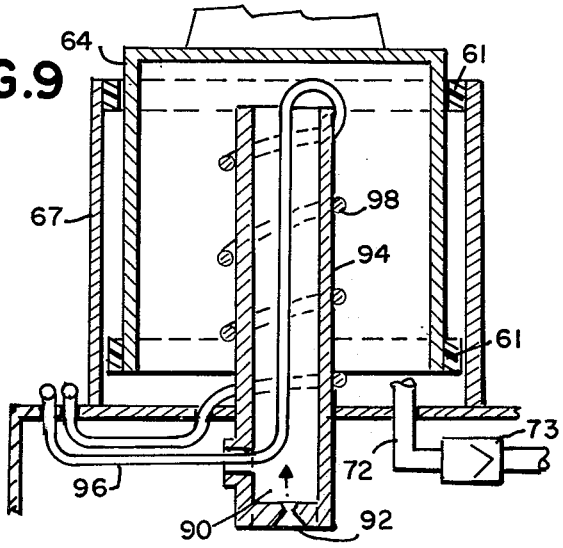
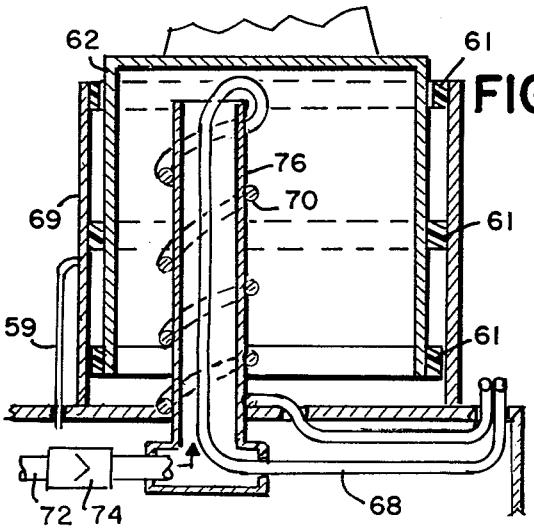
FIG.10
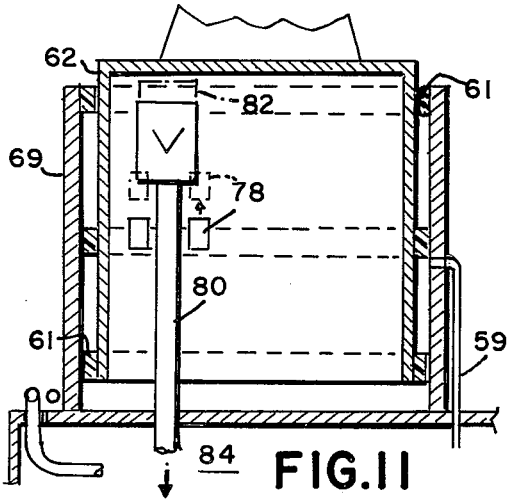
FIG.11

NONCOMBUSTION ENGINE

FIELD OF THE INVENTION

This invention relates to a noncombustion engine, particularly an engine which converts expansion and contraction energy of gas to mechanical power.

THE PRIOR ART

Stirling cycle engines are known, see U.S. Pat. No. 1,277,849 to Campbell et al., U.S. Pat. No. 3,407,593 to Kelly and U.S. Pat. No. 3,509,718 to Fezer et al. These engines operate by alternately heating and expanding, then cooling and contracting a quantity of gas, e.g., hot air to drive pistons and/or a flywheel. However, such machines have not realized wide acceptance and success due to factors which include the location of the hot and cold sides of the machine in adjacent chambers, which causes great stress on the chamber materials and high power loss and inefficiency since the hot and cold sides work against each other, i.e., tend toward equilibrium and lower the temperature differential therebetween.

There has heretofore not been a noncombustion engine which develops a high temperature differential and high power thrust and there is a need and market for such an engine that obviates the above shortcomings.

There has now been discovered a Stirling cycle engine wherein the hot and cold chambers are spaced apart, the pistons operating in cooperation to drive a flywheel or other annular body. This engine moreover operates employing a remote heat source without discharge of portions of the working fluid.

SUMMARY

Broadly, the present invention provides method and apparatus for developing noncombustion power comprising an annular body rotatably mounted, an expansion chamber mounted proximate the annular body, a power piston reciprocably mounted in said chamber, the outer end of the piston being in contact with a portion of the annular body spaced from the turning axis thereof, a contraction chamber spaced from the expansion chamber, a recovery piston reciprocably mounted in the contraction chamber, a chase connecting the chambers, the expansion chamber having working fluid at a first temperature and pressure therein means for heating the working fluid to an elevated second temperature and pressure which forces the power piston against the annular body rotating the same, means for driving the power piston back into the expansion chamber to expel and charge the fluid into the chase and thence into the contraction chamber to drive the recovery piston outward of said chamber, means for further cooling the fluid in the contraction chamber, and means for driving the recovery piston back into the contraction chamber to drive the cooled and contracted fluid back into said expansion chamber to recommence the power cycle and drive the annular body.

DESCRIPTION

The invention will become more apparent from the following detailed specification and drawings in which:

FIG. 2 is a plan, partially schematic, view of another apparatus embodying the noncombustion engine of the present invention;

FIG. 3 is an elevation view of the engine embodiment of FIG. 2;

FIG. 4 is an enlarged fragmentary sectional elevation of the embodiment of FIG. 2 taken on line 4—4 looking in the direction of the arrows;

FIG. 5 is a schematic elevation view of the embodiment of FIG. 2 taken on line 5—5 looking in the direction of the arrows;

FIG. 6 is a partial sectional elevation view of the noncombustion engine of FIG. 2 taken on line 6—6 looking in the direction of the arrows;

FIG. 7 is an enlarged fragmentary sectional elevation view of the portion of the embodiment shown in FIG. 5;

FIG. 8 is an end view of the large fragment shown in FIG. 7;

FIG. 9 is an enlarged fragmentary sectional elevation detail of a portion of the noncombustion engine of FIG. 5;

FIG. 10 is an enlarged fragmentary sectional elevation detail of another portion of the embodiment of FIG. 5;

FIG. 11 is a view of the fragment of FIG. 10 rotated 180°;

Figure 1:
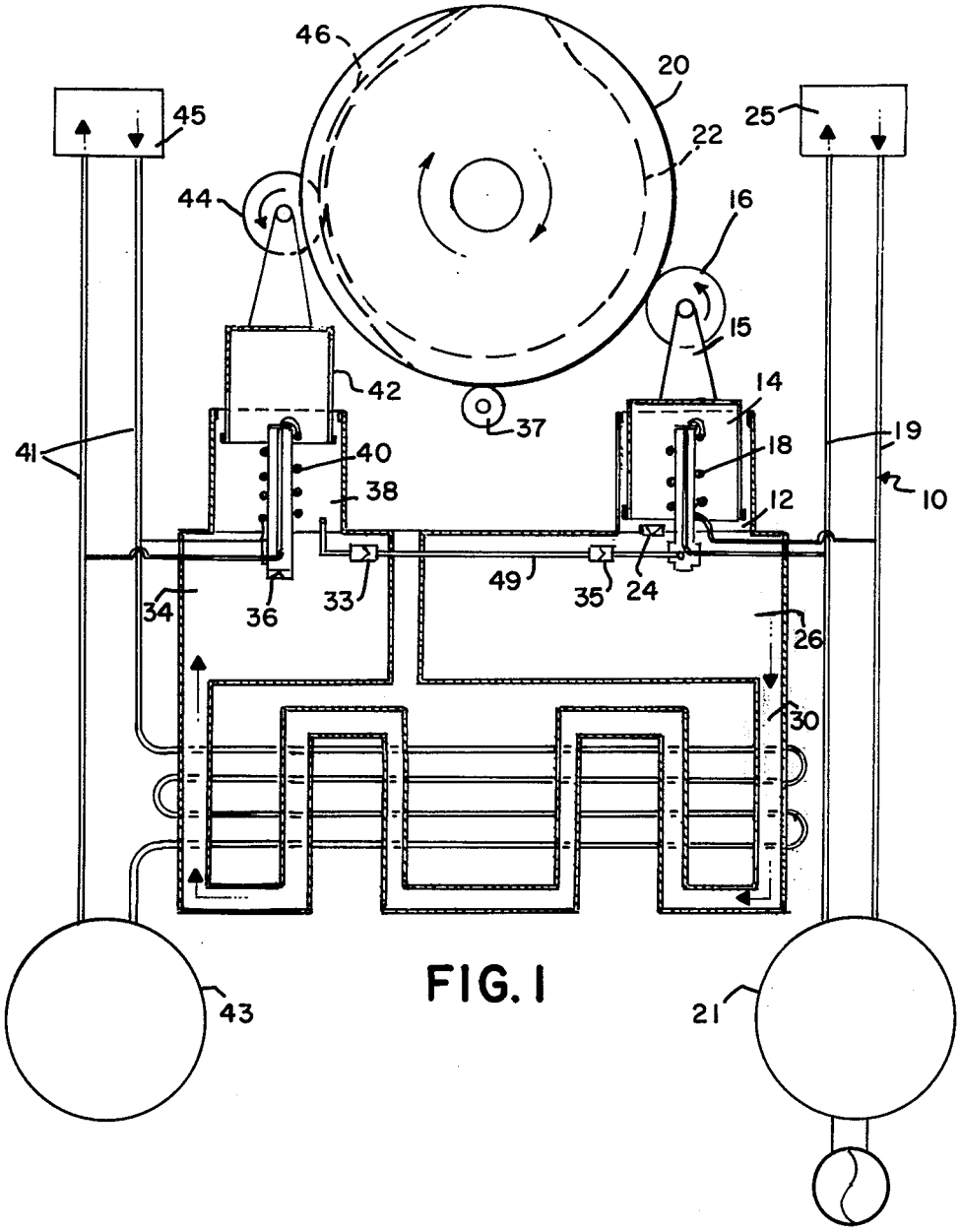
FIG. 1 is an elevation schematic view of an apparatus embodying the noncombustion engine of the present invention.

Referring now to the drawings, in a simple two cylinder embodiment of the invention, engine 10 has expansion chamber 12 surmounted by power piston 14 which carries support bracket 15 and piston roller 16 thereon, as shown in FIG. 1. Expansion chamber 12 contains gas, e.g. nitrogen or air at 45 PSI at room temperature, which is heated by heating coil 18 to 1400°K which expands the fluid to 1875 PSI therein. The piston roller 16 rides in a cam groove 22 (solid line) of flywheel 20, as shown in FIG. 1 and is held down thereby while the fluid pressure builds up therein until the cam groove 22 slopes inwardly (dotted line) whereupon the piston roller 16 moves up against the flywheel 20, turning the same in the indicated clockwise direction. When the piston 14 reaches the top of its stroke, mechanical release valve 24 opens at the base of the expansion chamber 12, and concurrently the cam groove slopes outwardly to the flywheel surface, so that the rotating flywheel 20 then drives the power piston 14 downwardly into the expansion chamber 12 (where it is held down during the next pressure build-up cycle) to expel the pressurized gas in such chamber through the mechanical release valve 24 into first pressure reduction chamber 26 which components are shown in FIG. 1. In the chamber 26, the gas cools to reduced pressure, thence the gas passes into cooling coils 30 and then to second pressure reduction chamber 34 where the gas further cools and contracts as shown in FIG. 1. The gas then passes through check valve 36 into contraction chamber 38 where it is further cooled by cooling coil 40 to 672°K, contracts, fills said chamber and forces recovery piston 42 upward to the top of its stroke, the piston roller 44 riding in its own cam groove 46, in the turning flywheel 20, as shown in FIG. 1.

When the recovery piston 42 reaches the top of its stroke check valve 36 automatically closes and the cam groove slope 46, steeply reverses and slams the recovery piston 42 downwardly into its contraction chamber 38, which compresses the fluid therein and drives a shot of cooled fluid through check valves 48 and 50 into expansion chamber 12, where the cycle is recommenced. Power is transmitted from rotating flywheel 20 by power take-off shaft 52 as shown in FIG. 1.

The expansion chamber 12 is heated by heating coil 18 which is connected to circulatory pipes 19, heater 21 and pump 25, while contraction chamber 38 is cooled by cooling coil 40 which is fed by lines 41, cooler 43 and pump 45, all as shown in FIG. 1. Lines 41 further serve to cool cooling coils 30 as shown in FIG. 1.

In operation the power piston undergoes fluid pressure build-up and periodically drives the flywheel on its upstroke exerting about 1875 PSI, the flywheel being driven counter to the direction of the upstroke of the power piston as indicated by the arrow of FIG. 1, due to the side-wise thrust of the piston roller 16 in the cam groove 22 of such flywheel. The recovery piston is periodically driven by the flywheel on its downstroke against the resistance of only about 45 PSI, so as to feed the power piston with successive charges of cooled gas. The only power input is energy to heat the heating fluid and cool the coolant and to operate the two pumps which circulate the heating fluid and coolant in their respective coils as shown.

In actual practice, a series of power pistons, e.g., three, each out of phase, drive the flywheel within their respective cam grooves.

Thus, in multi-piston noncombustion engine 47, flywheel drum 48 is driven by power pistons 50, 54, 58 and 62 which are each successively 90° out of phase and which ride respectively in cam grooves 51, 55, 59 and 63 as shown in FIGS. 2 and 3. The drum 48 concurrently drives recovery pistons 52, 56, 60 and 64 which are paired with the above power pistons, as shown, which recovery pistons ride respectively in cam grooves 53, 57, 61 and 65 as shown in FIGS. 2 and 3.

All the pistons ride in their respective cam grooves on piston rollers such as piston roller 66 shown in FIGS. 5, 7 and 8. Such rollers are also shown in FIG. 3 but omitted for clarity in FIG. 2.

The power pistons are heated by heat source 57 and heating line 68 which connects to the respective heating coils thereof, e.g., heating coil 70 in power piston 62 as shown in FIGS. 2, 5 and 10.

Cooled working fluid is charged into the power pistons, e.g., at chase 72 past check valve 74 and through heated pipe 76 as shown in FIGS. 5 and 10 to heat and expand, driving the power piston 62 up against the drum 48 to rotate the same as previously described; see the rotational arrows in FIG. 5. When the power piston, e.g., piston 62, rises, valve lugs 78 mounted on the inside piston wall rise therewith into contact with release valve 82 opening the same (see dotted lines) to release the heated and expanded working fluid through standpipe 80 as shown in FIG. 11. The fluid is thus released to the first pressure reduction chamber 84 as the piston 62 is driven on its descent stroke by cam 63 on drum 48, as shown in FIGS. 2, 5, 10 and 6. As the piston 62 nears the bottom of its stroke, valve lugs 78 descend and the piston 62 contacts valve 82 and returns it to its closed position on standpipe 80.

The working fluid thus is discharged sequentially from the power pistons into the first pressure reduction chamber 84 from whence it flows into finned serpentine cooling duct 86 in radiator 87 for further cooling and thence to second pressure reduction chamber 88 for further cooling as shown in FIGS. 3 and 6. The pressure reduction chambers 84 and 88 are separated by thorough insulation 85.

The fluid then flows sequentially up through the recovery piston inlets, e.g., through inlet 90, past check valve 92, through cooled pipe 94 into recovery piston 64, as shown in FIGS. 6, 5 and 9, to further cool and drive the recovery piston 64 up in its cam groove 65 as previously described.

When the recovery piston 64 reaches the top of the stroke, the rotating cam groove reverses its slope and drives the piston 64 downward, as previously described, charging the cooled and contracted working fluid out of the piston into chase 72, as shown in FIGS. 5 and 9, past check valves 73 and 74 and into heated pipe 76 of power piston 62 to reheat the working fluid and recommence the power cycle.

The recovery pistons are cooled by compressor 95 and line 96 which connect to the cooling coils thereof, e.g., cooling coil 98 as shown in FIGS. 2, 3, 5 and 9.

The compressor 95, which is belt driven off flywheel drum 48, by belt 91, pumps the coolant through line 96 and then across the inner face of the radiator 87 by the line 97 to cool the same, from which line 97 returns to the compressor. Radiator 87 is further cooled by fan blade 89 which is rotatably mounted on drum 48 as shown in FIGS. 2 and 3.

The flywheel drum 48 rotates on axle 100 which rides on a low friction bearing assembly 101 having two concentric sets of needle bearings 102 and 104 separated by an idler ring 106, all encased in a tapered ring seat 108 as shown in FIG. 4.

Accordingly, the only power input required in the above embodiment, aside from start-up, is energy to heat and circulate the heating matter e.g., dowtherm in the respective coils. The cooling unit is self-sufficient as described above. As for start-up and maintenance, fluid charging ports 49 and 51, shown in FIG. 2, are employed for flushing and pressurizing the engine 47 with working fluid, feeding new fluid in one port and removing exit fluid from the other of said ports, while turning the flywheel drum to assist fluid circulation.

Figure 12:
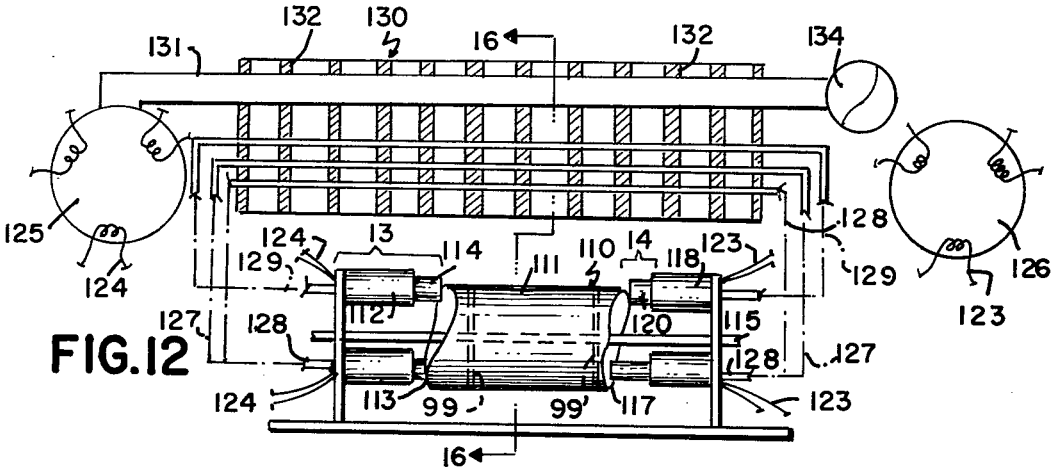
FIG. 12 is an elevation schematic view partly in section of another noncombustion engine embodying the present invention.
Figure 13:
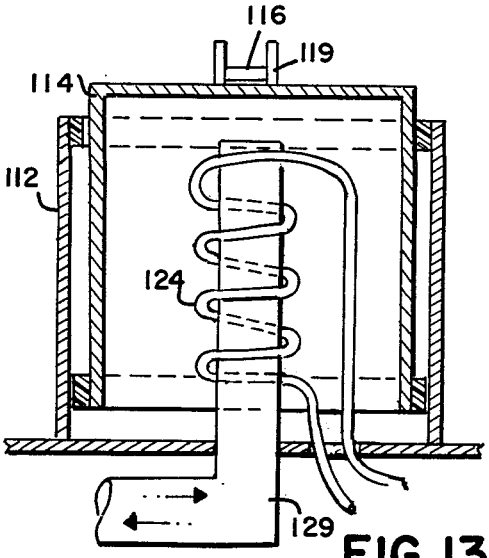
FIG. 13 is an enlarged fragmentary sectional elevation detail of a portion of the embodiment of FIG. 12.
Figure 14:
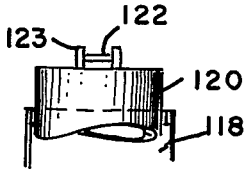
FIG. 14 is an enlarged fragmentary detail of another portion of the embodiment of FIG. 12.
Figure 15:
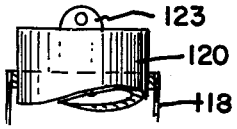
FIG. 15 is an end view of the fragment of FIG. 14.
Figure 16:
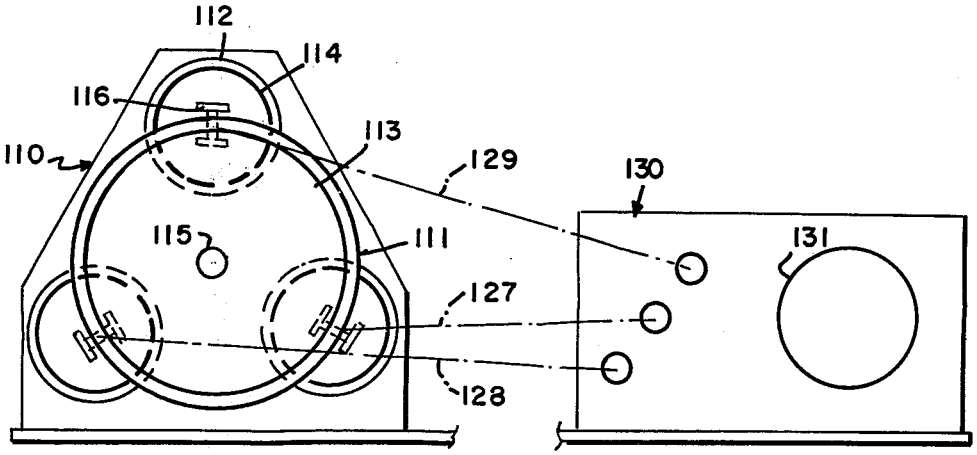
FIG. 16 is a sectional elevation view of the noncombustion engine of FIG. 12 taken on line 16—16 looking in the direction of the arrows.

In another embodiment of the present invention, end drive noncombustion engine 110 has an expansion chamber 112 surmounted by a power piston 114 having mounted thereon roller bracket supports 119 and piston roller 116 which contacts the end of the barrel cam 111 on cam ridge 113 as shown in FIGS. 12, 13 and 16. At the other end of barrel cam 111, which rotates on axis 115, is contraction chamber 118 surmounted by recovery piston 120 on which is mounted roller bracket supports 123 and piston roller 122 which contacts the opposite end of barrel cam 111 on cam ridge 117 as shown in FIG. 12, 14 and 15.

As shown in FIGS. 12, 13 and 16, three such power pistons 114 are mounted in contact with the barrel cam about 120° apart (and out of phase) thereon, which power pistons are paired respectively with three such recovery pistons 120 which are mounted at 120° intervals at the other end of the barrel cam 111, in contact therewith. FIGS. 12, 14 and 15.

The power pistons, as shown in FIG. 13, are heated by heating coil 124 from the heat source 125. The recovery pistons which have the same construction as the power pistons, such as shown at FIG. 13, are each cooled by a cooling coil such as coil 124 from cold source 126, FIG. 12.

Accordingly, cool working fluid at about 45 PSI sequentially enters each power piston 114 via transfer chase 129. FIG. 13, where the fluid is heated and expanded to 1400°K and 1875 PSI which pushes power piston 114 and piston roller 116 outwardly against cam ridge 113, FIG. 12, turning the same on axis 115 as each each piston 114 moves in sequence to the end of its power stroke. The barrel cam continues turning and then by reverse cam slope forces the power piston 114 in the reverse direction which expels the heated and expanded gas back into the transfer chase 129 where it is cooled as it passes through economizer 130, within said chase 129 and thence passes into contraction chamber 118, where the fluid is further cooled by the cooling coil 123 therein (which is constructed like coil 124 of FIG. 13), while filling said contraction chamber and forcing the recovery piston 120 against the cam ridge 117 until it reaches the end of its stroke. Thereupon, the turning action of barrel cam 111 and the change of slope of cam ridge 117 forces the recovery piston 120 to suddenly reverse stroke and expel the cooled and contracted gases out of the contraction chamber 118, back into the transfer chase 129, and through the economizer 130, where the gases are heated en route to expansion chamber 112, where further fluid heating and expansion take place and the power cycle is repeated, all in the apparatus shown in FIGS. 12 and 16.

The three power pistons and their associated recovery pistons are positioned, as previously described, 120° apart on the ends of the barrel cam 111, which power pistons act 120° out of phase to sequentially drive said barrel cam 111. Each power-recovery piston pair are connected by their own transfer chase as indicated by dotted lines 127, 128 and 129 shown in FIGS. 12 and 16.

The heating coil 124 is fed by lines from heater pump 125. The cooling coil 123 is fed by lines from cooler pump 126. The heat exhaust gas from heater pump 125 passes through flue 131, which heats vanes 132 of the economizer 130 en route to the flue exhaust 134. The flue vanes 132 are heated to a lesser extent as the flue gas nears its exhaust, and the flue gas is concurrently cooled en route to discharge.

Recovery piston 64 reciprocates in chamber 67 as shown in FIG. 9; power piston 62 reciprocates in chamber 69 as shown in FIGS. 10 and 11 and piston 114 reciprocates in chamber 112 as shown in FIG. 13. The respective pistons and chambers are separated by bearings 61 as shown in FIGS. 9, 10, 11 and 13. These bearings can be of poly-tetra fluoroethylene ("Teflon") or oil impregnated metal bearings (e.g., of brass, bronze) known as "Oilite" and the like in ring or other form. Conventional piston rings can be employed, which, of course, require lubrication. Bleeder tubes 59 advantageously vent pressure build-up or vacuum between bearing seals 61 as shown in FIGS. 10 and 11.

In actual operation, the working fluid is heated, expanded, driving in sequence one or more power pistons, which drives a barrel cam; the heated and expanded fluid is then propelled through the transfer chase to the cool side of the engine, where it is cooled, contracted and shuttled back to the heated side periodically. The power piston exerts high PSI, as above stated in the first embodiment and the recovery piston or pistons are driven by the barrel cam against a far less PSI so as to feed the power piston or pistons with successive charges of cooled fluid. Advantageously, a series of power, recovery piston pairs, each pair out of phase around the barrel cam ends respectively, drive the barrel cam in sequence. Preferably, concentric needle bearings such as shown in FIG. 4 are employed in the mounting of barrel cam 111.

Thus, the noncombustion engine embodying the present invention utilizes a Stirling Cycle wherein working fluid either shuttles between hot and cold sides or circulates around a closed system, in turn being heated, expanded, cooled and contracted.

In further operational detail, in the deflection drive embodiment, illustrated in FIGS. 1, 2 and 3, the transfer of heat to the expansion chamber expands the working fluid (nitrogen, demoisturized air) opening the power piston, during which time the recovery piston is closed by the cam action of the flywheel. The recovery piston is then reopened for the major part of its cycle to assist the filling thereof with cooled fluid. During the outward stroke of the power piston against the flywheel, in the case of the embodiments illustrated in FIGS. 1, 2 and 3, the valve 24 or 82 remains closed until the power piston reaches the top of its stroke, at which point valve 24 or 82 opens as described. Thereupon, the power piston is abruptly closed by the cam action which drives the working fluid out of the expansion chamber to a pressure reduction chamber, or in a simpler embodiment, directly to the other side of the engine to a contraction chamber and recovery piston as previously discussed. In the end drive embodiment, by cam action, the opening of the recovery piston coincides with the closing of the power piston, in a pair thereof (and vice versa), the working fluid being transferred from the power piston to the recovery piston, as in the embodiments shown in FIGS. 12 and 16.

It can be seen from the above invention, that in both embodiments, the hot and cold sides of the Stirling cycle, are considerably separated and accordingly do not act against each other. The first embodiment, deflection drive, provides a circulatory system with a series of check valves which permit one way circulation. In the second embodiment, end drive, a shuttle system with no check valves, is provided and the working fluid shuttles back and forth according to strokes of the respective pistons.

Preferably, the pistons are cup shaped to hold gas therein and to surround the heating and cooling coils respectively, although solid pistons can be employed.

The pistons and chambers are preferably cylindrical, although other cross-sectional shaped pistons can be employed where desired. The pistons and chambers are of rigid material, e.g., metal, able to withstand high pressure.

The deflection drive embodiment of the present invention, particularly FIGS. 1, 2 and 3, is highly efficient in that, for example, where the power take-off is employed to drive a generator, the horsepower recovered is up to 45% or more of the horsepower input to the system, i.e., by the heating and cooling energy input. In the end drive embodiment, the HP recovered is up to 45% or more of input.

The noncombustion engine embodying the invention can come in various sizes depending upon the application. For example, the end drive engine embodiment of FIGS. 12 and 16 can be a small, light, portable unit for such uses as a portable electric power generator, a portable compressor, and constant speed required uses such as power tools and the like.

The deflection drive embodiment of FIGS. 1, 2 and 3 can be a small unit or a large unit in which annular body or flywheel 20 is a large mass, e.g., 100 pounds or up to much greater weights for delivery power to the power receiving unit, e.g., engines, generators, or other power receiving units including reciprocal units, e.g., cranks and the like.

As stated, the light-weight end drive barrel cam engine functions as a fluid shuttle model. For heavier models, the fluid shuttle system can be replaced with a fluid circulatory system with check valves of the kind illustrated in FIGS. 1, 5, 6, 9 and 10, if desired.

The fluid enclosed in the unit can be various gases available. However, inert gases such as nitrogen and air are preferred, particularly air low in moisture content.

Various pressure and temperatures applied to the gas within the system can be employed as desired. In a preferred embodiment, the system is pressurized at 45 PSI and at room temperature, 530°K with air demoisturized to ± 0.01% by weight. At the upper end of the cycle, the temperature in the power piston is calculated to reach 1400°K at 1875 PSI.

As indicated above, in the noncombustion engine of the present invention, the heat is not forced through the walls, nor is the hot side adjacent the cold side of the engine, as disclosed in the prior art, rather, the "cold" and "hot" (less cold) elements are separated and insulated into (1) a recovery piston acting as a displacer force and (2) a power piston which transfers the energy to the output drive.

The expansion chamber can be heated by circulating dowtherm (a commercial boiler fluid), oil, or other fluid to coils in the power pistons; the heating fluid being heated by a burner, charcoal, wood, gas and the like. Electrical, including electrical rods, or nuclear heat source can also be substituted. Moreover, heat can also be supplied directly to each power piston by any of the above means if desired. Further, to the extent heat can be delivered to the power pistons by "wick-core" pipes, i.e., by wicking action, return lines and pump can be dispensed with.

The recovery piston situated at the colder side of the noncombustion engine embodying the invention, is cooled by a coil having circulating within, a cooling agent, e.g., freon, or other fluid, such as cold water, brine and the like.

It is recommended in the end drive noncombustion engine embodying the invention (FIGS. 12 and 16) that three or more pairs of power and recovery pistons be employed, operating out of phase on the barrel cam to insure smooth operation.

In the deflection drive embodiment of the noncombustion engine of the present invention (FIGS. 1, 2 and 3) one or more pairs of power-recovery piston pairs can readily be employed, two or more pair being preferred.

The power take-off for both the embodiments of the invention can be located at the axis or periphery of the flywheel or at an intermediate point thereof.

An economizer is preferably employed to assist in the heating and cooling of the working fluid of the end drive embodiment of the invention. The working fluid can be shuttled without such economizer if desired. The economizer, which can be heated with flue exhaust, can include metal vanes separated by air or other insulation, can include a series of insulated containers filled with fluids of boiling points of decreasing value and the like.

What is claimed is:

1. A noncombustion engine comprising an annular body rotatably mounted; an expansion chamber mounted proximate said body; a power piston reciprocably mounted in said chamber, the outer end of said piston being in contact with a portion of said annular body spaced from the turning axis thereof; a contraction chamber spaced from said expansion chamber; a recovery piston reciprocably mounted in said contraction chamber, spaced from said expansion chamber; a conduit connecting said chambers; said expansion chamber having fluid at a first temperature and pressure therein; means for heating said fluid to an elevated second temperature and pressure which forces said power piston against said annular body rotating the same; means for driving said power piston back into said expansion chamber to expel and charge said fluid into said conduit, and thence into said contraction chamber, to drive said recovery piston outwardly of said chamber; means for further cooling said fluid in said contraction chamber and means for driving said recovery piston back into said contraction chamber to drive the cooled and contracted fluid back into said expansion chamber to recommence the power cycle and drive said annular body.

2. A noncombustion engine comprising, a flywheel rotatably mounted on its axis; a fluid expansion chamber mounted proximate said flywheel; a power piston reciprocally mounted in said chamber, the outer end of said piston being in contact with the peripheral portion of said flywheel; pressure reduction means connected by a release port, to said expansion chamber for expanding and cooling said fluid; a contraction chamber connected via a check valve to said pressure reduction means, spaced from said expansion chamber; a recovery piston reciprocally mounted in said chamber, the outer end of said piston being in contact with another peripheral portion of said flywheel; means for feeding fluid at a first pressure and temperature into said expansion chamber; means for heating said input fluid to an elevated temperature such that the pressure in said expansion chamber increases to force said power piston out of said expansion chamber against said flywheel rotating the same; means for opening said release port; means for driving said piston back into said expansion chamber to expel and charge said fluid into said pressure reduction means for cooling and reducing the pressure thereof; means for charging the so-cooled, reduced-pressure fluid into said contraction chamber to drive said recovery piston outwardly against said flywheel; means for further cooling and contracting the fluid within said chamber and means to drive said recovery piston back into said contraction chamber to drive said cooled fluid into said expansion chamber to recommence the power cycle and drive said flywheel.

3. The engine of claim 1 wherein said power piston contacts said annular body at one end thereof spaced from the axis thereof.

4. The engine of claim 1 wherein said power piston contacts said annular body at one end thereof spaced from the turning axis thereof and the recovery piston contacts said annular body at the other end thereof spaced from the turning axis thereof, the respective ends of said annular body having cam sloped surfaces to cooperate with reciprocal movements of said pistons as said annular body rotates.

5. The engine of claim 4 wherein a plurality of pairs of power and recovery pistons contact said annular body at opposite ends thereof in spaced phased power relationship.

6. The engine of claim 4 wherein a plurality of power pistons contact said annular body at one end thereof spaced from the turning axis thereof, and a plurality of recovery pistons contact said annular body at the other end thereof spaced from the turning axis thereof, the respective ends of said annular body having cam sloped surfaces to cooperate with reciprocal movements of said pistons as said annular body rotates.

7. The engine of claim 4 wherein said conduit has an economizer thereon including a metal grid therein for heat exchange passing therethrough.

8. The engine of claim 1 wherein said power piston contacts said annular body at an acute angle to the periphery thereof.

9. The engine of claim 1 wherein a separate return conduit is provided, connecting said chambers for passage of the contracted gas to said expansion chamber.

10. The engine of claim 1 wherein said conduit includes a first pressure reduction chamber connected to cooling coils, connected in turn to a second pressure reduction chamber and thence to said contraction chamber and a separate return conduit is provided connecting said expansion and contraction chambers.

11. The engine of claim 1 wherein said expansion chamber has a valve connecting it with said conduit; means for closing the valve during the power stroke of said power piston and means for opening said valve when said power piston reaches the top of its power stroke.

12. The engine of claim 1 wherein said pistons are cup shaped, being closed at the outer ends thereof.

13. The engine of claim 1 wherein said annular body has cam paths defined on the surfaces thereof for contact with said power and recovery pistons.

14. The engine of claim 2 wherein said annular body is a flywheel containing cam paths inscribed around the periphery thereof for contact with said power and recovery pistons, each path sloping inwardly to cooperate with the upstroke of its associated piston and sloping outwardly to cooperate with the downstroke of said piston.

15. The engine of claim 2 wherein a plurality of pairs of said power and recovery pistons contact spaced cam paths on the periphery of said annular body, the pairs operating out of phase with each other to drive said annular body.

16. The engine of claim 2 wherein said pressure reduction means includes a first pressure reduction chamber connected to a radiator coil connected in turn to a second pressure reduction chamber.

17. The engine of claim 2 wherein said power piston contacts said annular body at an acute angle to the periphery thereof.

18. The engine of claim 1 wherein a heating coil heats said expansion chamber, a cooling coil cools said contraction chamber and power take-off means contact said annular body to transmit power therefrom.

19. The engine of claim 1 wherein each end of the flywheel axle turns on a pair of concentric sets of needle bearings separated by an idler ring therebetween.

20. A method for developing noncombustion engine power comprising feeding a gas at a first temperature and pressure into an expansion chamber having a reciprocably mounted power piston therein; heating the gas in said expansion chamber to an elevated second temperature and pressure to drive said power piston out of said chamber against a rotatably mounted annular body to rotate the same, driving said power piston back into said chamber to expel and charge said gas from said chamber into a conduit, feeding the gas from said conduit into a contraction chamber having a reciprocably mounted recovery piston therein to fill said contraction chamber and drive said recovery piston out thereof; further cooling and contracting said gas in said contraction chamber; driving said recovery-piston into said contraction chamber to expel said gas from the said contraction chamber into said expansion chamber to recommence the power cycle and drive said annular body.

21. A method for developing noncombustion engine power comprising; feeding a fluid at a first temperature and pressure into an expansion chamber having a reciprocably mounted power piston therein; heating the fluid in said expansion chamber to an elevated second temperature and pressure to drive said power piston out of said chamber against a rotatably mounted flywheel to rotate the same; opening a fluid release port in said chamber; driving said power piston back into said chamber to expel said fluid from said expansion chamber; closing said release port, expanding and cooling said fluid; feeding said fluid into a contraction chamber having a reciprocably mounted recovery piston therein to fill said chamber and drive said recovery piston out thereof, further cooling said fluid in said contraction chamber; driving said recovery piston back into said chamber to expel said fluid from said contraction chamber and drive said fluid into said expansion chamber to recommence the power cycle and thus drive said flywheel.

* * * * *